United States Patent [19]

Gutnik

[11] Patent Number: 4,815,193

[45] Date of Patent: Mar. 28, 1989

[54] RIVET INSTALLATION TOOL AND METHOD OF INSTALLING RIVETS

[75] Inventor: Saul Gutnik, Irvine, Calif.

[73] Assignee: Cherry Division of Textron, Inc., Santa Ana, Calif.

[21] Appl. No.: 158,311

[22] Filed: Feb. 22, 1988

[51] Int. Cl.[4] ..... B23D 11/00

[52] U.S. Cl. ..... 29/509; 29/522.1; 29/526.2; 29/243.53; 72/354; 173/128; 173/133; 227/61; 227/62; 227/152; 411/501

[58] Field of Search ..... 29/509, 522.1, 526.1, 29/526.2, 243.53; 411/500, 501, 504; 72/354; 10/27 E; 173/128, 131, 133; 227/61, 62, 152, 153

[56] References Cited

U.S. PATENT DOCUMENTS 4,610,072 9/1986 Müller ..... 227/62 X 4,688,317 8/1987 Matuschek ..... 29/509

4,716,755 1/1988 Bulso, Jr. et al. ..... 72/354

FOREIGN PATENT DOCUMENTS 2238190 2/1974 Fed. Rep. of Germany ..... 411/504

*Primary Examiner*—Timothy V. Eley

*Assistant Examiner*—Frances Chin

*Attorney, Agent, or Firm*—Knobbe, Martens, Olson & Bear

[57] ABSTRACT

A tubular sleeve clamps the work during a drilling step, following which a tubular anvil moves within the sleeve to support the work while a rivet is thrust into the work with an interference fit. The tubular anvil is then withdrawn and moved with an anvil pin to form an upset head. If desired, the pin can then be retracted, and the outer portion of the upset head partially sheared by the tubular anvil and flattened against the work.

16 Claims, 2 Drawing Sheets

RIVET INSTALLATION TOOL AND METHOD OF INSTALLING RIVETS

FIELD OF THE INVENTION

This invention relates to riveting and particularly to an apparatus and method for installing rivets that have an interference fit with the hole in which the rivet is installed.

BACKGROUND OF THE INVENTION

In certain riveting situations, such as some applications in the aircraft industry, it is believed desirable to have high-strength fasteners that are slightly larger than the hole in which they are to be installed, such that the rivets have to be forced into the hole with high interference. For example, titanium rivets may be forced into softer aluminum. This approach guarantees a tight fit with a rivet having high shear strength capabilities. Also, inserting the rivet, cold-works the material through which the rivet is inserted, thereby hardening and strengthening it.

When working with regular riveting tools, the clamping force is not sufficient to support the workpiece enough to drive a rivet in the hole with high interference. As a result, aircraft manufacturing has developed other techniques such as to employ rivets of special shapes or special coatings, or use vibrational inserters, and reduce the interference in the rivet installation. With such approaches, the cost of installation is increased, but yet maximum strength is not achieved.

In some manufacturing operations, holes through workpieces are pre-drilled, and riveting is later performed after a separate positioning and clamping operation. This requires accurate alignment and coordination between the drilling and riveting operations, and increases expense. It is desirable that the rivet hole be drilled immediately preceding the installation of the rivet using the same fixturing and clamping arrangement. This approach is more accurate and more efficient.

It is particularly desirable to have an efficient installation tool for a recently developed rivet of the type disclosed in U.S. Pat. No. 4,688,317, issued to the same assignee as the present invention. With that rivet, a portion of an upset head is partially sheared from the head and flattened against the workpiece. This technique provides tension on the rivet shank to maintain a tight joint.

SUMMARY OF THE INVENTION

Briefly stated, the invention provides an improved method of installing a rivet to obtain an interference fit and an improved tool for practicing such method. The system employed provides the necessary support for the workpiece to withstand the force needed to insert a rivet in the hole with high interference and if necessary to cold-work the material forming the holes in the workpieces joined.

In accordance with the method of the invention, the workpieces to be joined are first clamped between a fixture and a clamping sleeve. If the hole for the rivet has not yet been formed in the workpieces, the hole is then drilled from the fixture side to the clamping sleeve side. The drill is then withdrawn and a tubular anvil, which is slidably positioned within the sleeve, is pressed against the workpiece with the anvil closely surrounding one end of the hole through the workpieces. A force is applied to the anvil which is greater than the clamping force; however, it is desirable that the clamping action provided by the sleeve be also maintained on the workpieces so that the workpieces continue to be clamped when the anvil is withdrawn. With the anvil in position, a rivet is driven through the hole from the fixture side of the workpieces. If the diameter of the rivet is slightly larger than the diameter of the hole, the rivet enlarges the hole and cold-works the material forming the walls of the hole. This ensures a snug fit and strengthening of the connection due to the cold-working of the material, which is typically aluminum in aircraft assembly. The tubular anvil immediately surrounding the rivet hole adequately accommodates the insertion force on the workpieces.

At this stage, the anvil is retracted to make room for an upset head to be formed on the rivet, while the clamping force through the sleeve continues to clamp the workpieces. An anvil pin within the tubular anvil is then pressed against the end of the rivet to form an upset head on the rivet. The tubular anvil moves with the anvil pin so as to assist in the upsetting of the head as the upset material flows outwardly. The operation is then complete, if a plain solid rivet with a conventional upset head is desired.

If the special riveting technique that is referred to in the above-mentioned patent is employed, a further step is needed. The anvil pin is withdrawn and the tubular anvil is pressed towards the workpiece against the upset head to partially shear an outer portion of the upset head and to flatten this partially sheared material against the workpiece. The tool is then withdrawn which results in the rivet shank being left with tension on it producing the desired riveted connection.

From the foregoing, it can be appreciated that the tool of the invention employs a tubular anvil which may be moved into and out of engagement with the rivet or a workpiece with suitable means, such as by a conventional hydraulic ram. A clamping sleeve slidably surrounds the tubular anvil and may be selectively moved axially against a workpiece by suitable means, such as pneumatic pressure. The anvil pin is slidably positioned within the tubular anvil and is movable axially with the anvil during the head upset step, but is also movable axially relative to the anvil by suitable means to permit the tubular anvil to perform its anvil function during the rivet insertion step. In one simple example, a wedge is inserted transversely to the pin to engage a cam on the end of a pin and thereby force the pin outwardly with respect to the anvil a predetermined amount.

DETAILED DESCRIPTION OF A PREFERRED FORM OF THE INVENTION

Figure 1:
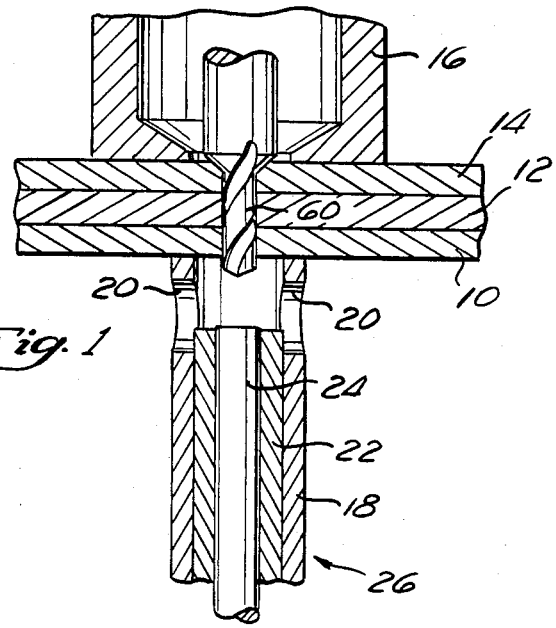
FIG. 1 is a cross-sectional, somewhat schematic view of a portion of the riveting tool of the invention after the initial clamping and drilling steps have been performed on workpieces.

Referring first to FIG. 1, there is illustrated a plurality of workpieces to be joined by a rivet, the work or workpieces being illustrated in the form of a plurality of flat sheets 10, 12 and 14. The sheets are clamped between the end of a tubular fixture 16 and a tubular clamping sleeve 18. The sleeve has two or more holes 20 in its sidewall near the sleeve end engaging the workpiece 10.

Figure 6:
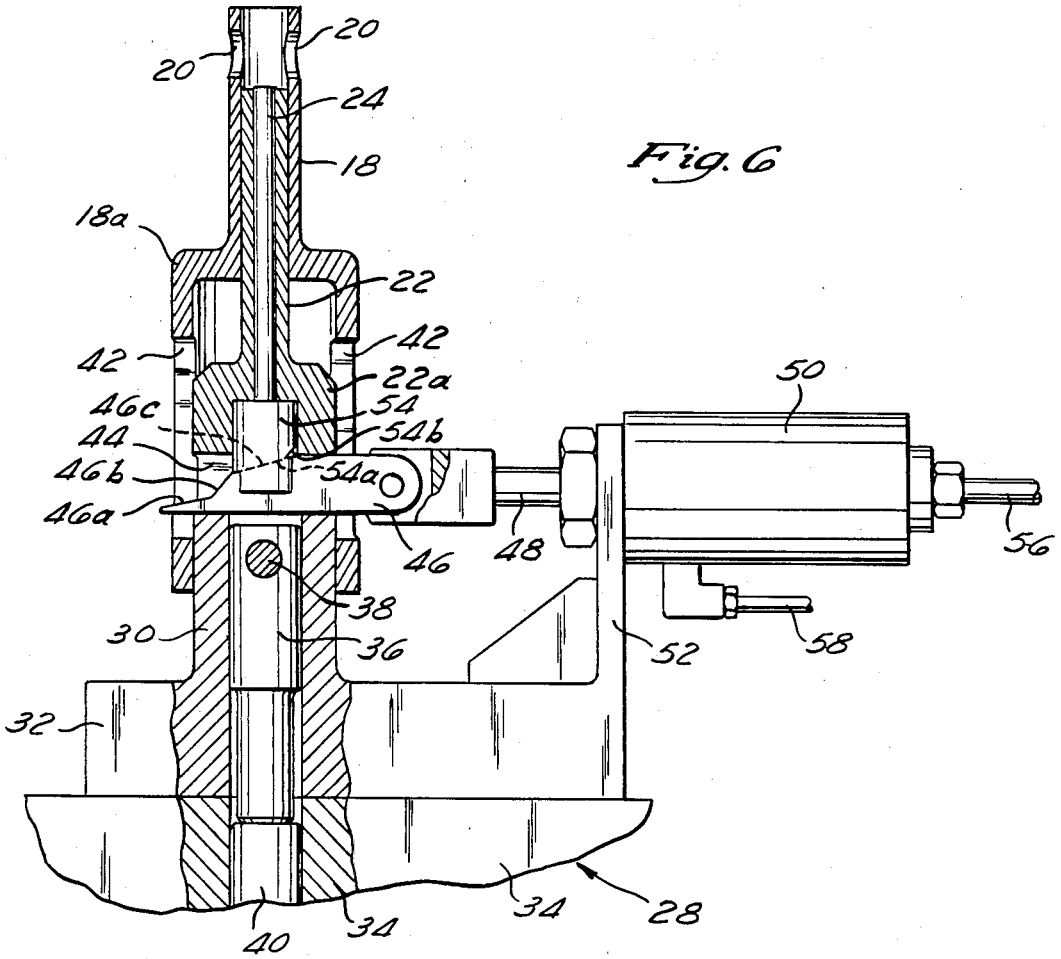
FIG. 6 is an enlarged, partially sectionalized, somewhat schematic view of the rivet installation tool and riveting head.

Positioned within the clamping sleeve is a two-part anvil including an outer tubular anvil 22 and an inner cylindrical anvil pin 24. The clamping sleeve, the tubular anvil and the anvil pin are all axially slidable relative to each other. These components form part of a riveting tool 26, one example of which is illustrated in FIG. 6, together with a portion of one type of conventional riveting machine, schematically shown at 28.

The tubular anvil 22 is formed with an enlarged lower end 22*a* which is rigidly connected by suitable bolts (not shown) to a tubular pedestal 30 mounted on a base plate 32. An adjustment plate (not shown) may be positioned between the pedestal 30 and the base plate 32, together with other connecting components; however, for purposes of simplicity, these components are not illustrated. Instead, the pedestal is illustrated as being integral with the base. The base is engaged by a ram 34 which is utilized to move the installation tool toward and away from the workpieces and to provide the necessary pressure to form an upset head on a rivet. The ram 34 is moved and held by a suitable force, typically hydraulic pressure.

The clamping sleeve 18 includes an enlarged portion 18*a* on its lower end which is slidably mounted on the anvil 22 and the pedestal 30, with the lower end of the clamping sleeve enlarged portion 18*a* being spaced from the base 32 connected to the anvil. Slidably positioned within a bore in the pedestal 30 and base 32 is a push rod 36, which is connected on its upper end to the enlarged lower end 18*a* of the clamping sleeve 18. This is accomplished by a pin 38 which extends transversely through the push rod, and through axially extending slots (not shown) in the upper end of the pedestal 30 and into the sleeve lower end 18*a*. Thus, the push rod 36, connecting pin 38 and sleeve 18 can move axially independently of the anvil. The lower end of the push rod 36 is engaged by an actuator piston 40, which forms a portion of the riveting machine 28 and is separately movable from the ram 34 by suitable means such as pneumatic pressure.

Suitable means are provided to move the anvil pin 24 relative to the tubular anvil 22. One example of such is illustrated in the drawing and described below. The enlarged portion 22*a* of the tubular anvil 22 includes a pair of transversely extending slots 42. A similar but axially larger pair of slots 44 are formed in the enlarged lower end 18*a* of the clamping sleeve 18. A wedge 46 extends transversely through these slots and is connected to an actuator rod 48 extending outwardly from an actuator 50 mounted on a bracket 52 supported on the base 32.

The wedge upper portion facing towards the anvil pin 24 includes, on its end, three cam or wedge surfaces that extend at an angle with respect to the longitudinal axis of the anvil. The surface 46*a* on the outer end of the wedge has a relatively shallow angle with respect to horizontal, which surface 46*a* adjoins a central surface 46*b* having a steeper angle with respect to horizontal, which in turn adjoins the third surface 46*c* which has an angle that is the same as the first angle 46*a*. The first and third surfaces 46*a* and 46*c* are at an angle to mate with a surface 54*a* having a similar angle formed on the lower end of a wedge or cam 54 connected to the lower end of the anvil pin. Lead-in surface 546 of the cam 54 has an angle to mate with the surface 466. The cam is slidably mounted within the enlarged portion of the tubular anvil. Cam 54 is prevented from rotation to assure proper contact between the cam and the wedge.

Figure 1A:
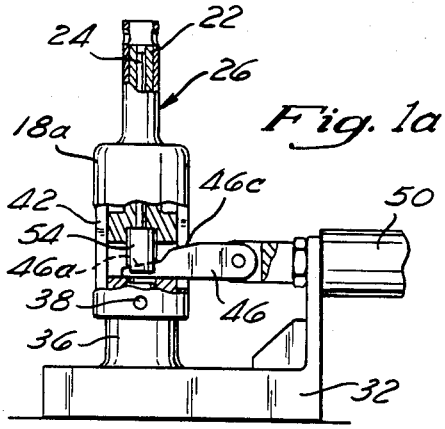
FIG. 1*a* is a side elevational, partially sectionalized, schematic view of the tool of FIG. 1 and a riveting head illustrating its position corresponding to FIG. 1.

The actuator rod 48 may be moved by suitable means such as pneumatic pressure, applied to the actuator 50 through conduits 56 and 58 to move the wedge horizontally into one of two positions engaging the cam 54. In the anvil pin extended or operative position shown in FIG. 6, the cam surface 54*a* engages the third surface 46*c* on the wedge to hold the anvil pin 24 in its extended position, wherein the upper end of the anvil pin is close to the upper end of the tubular anvil so that the two-part anvil is used together in upsetting the end of a rivet. In a retracted position, the wedge 46 is withdrawn to the right, as viewed in FIG. 1*a*, by the actuator 48 so that the anvil pin 24 and cam 54 will fall to the position, wherein the cam surface 54*a* engages the first wedge surface 46*a*, which is illustrated in FIG. 1*a*. The steeper middle cam surface 46*b* on the wedge is provided to be able to move the cam 54 and pin 24 through a considerable axial distance with a short wedge and small amount of movement of the actuator rod 48.

Operation

Referring now to FIG. 1, the workpieces are initially clamped, between clamping sleeve 18 and the tubular fixture 16. The sleeve is held in this clamped position by the push rod 36 and the pneumatic pressure applied to the lower end of the push rod by the piston 40. The workpieces are held with sufficient force to support them during a hole-drilling operation in the workpieces. Note that the tubular anvil 22 and the anvil pin 24 are positioned by the riveting ram 34 spaced from the workpieces, and the clamping sleeve 18 protrudes or extends beyond the end of the anvils 22, 24. While the tool in the method of the invention may be employed in connection with pre-drilled workpieces, the maximum advantage of the system described is provided by drilling the hole just prior to the riveting operation so that the drilling and riveting operation may be performed in a single setup and clamping procedure. Thus, as a first step after the workpieces have been clamped in the manner shown in FIG. 1, a hole is drilled through the workpieces by a drill 60 entering from the fixture side of the workpieces to the clamping sleeve side. The metal shavings are typically blown away through the holes 20 in the sleeve by way of a stream of shop air during the drilling operation.

After the hole has been drilled and countersunk, if desired, the drill 60 is withdrawn and the tubular anvil 22 is brought into engagement with the lower workpiece by moving the hydraulic ram 30 towards the workpiece. The tubular upset anvil is pressed against the lower workpiece 10 by hydraulic force which is greater than the force applied by the air actuated piston 40 on the clamping sleeve 18. The air cylinder is compressed, while providing the same clamping force (air is bled off through relieving type regulator). The sleeve supports the workpieces with the force which amounts to the difference between hydraulic and pneumatic forces. The upset anvil is locked in this position by suitable means in the hydraulic ram in the riveting machine, such as a hydraulic check valve.

Figure 2:
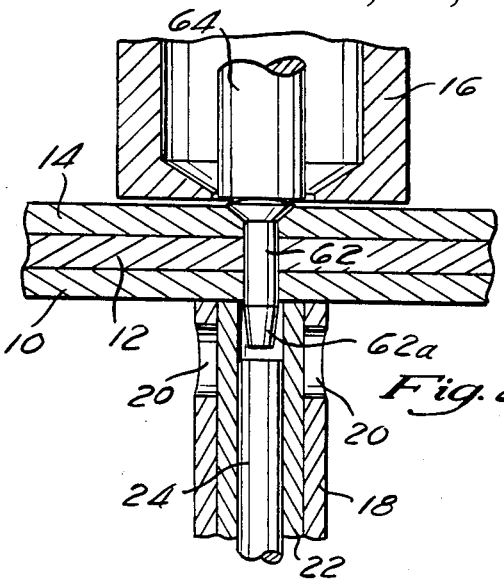
FIG. 2 illustrates the components of FIG. 1 during the rivet insertion step of the invention.

Note that, at this stage, the wedge is in the position of FIG. 1*a* such that when the tubular anvil is moved against the workpieces, the anvil pin is in a retracted position, as shown in FIG. 2. This can be accomplished by gravity or by a suitable spring arrangement, if desired. The pin could already have been in a retracted position with respect to the anvil during the drilling step illustrated in FIG. 1, such that during the movement into the position of FIG. 2, the tubular anvil and the anvil pin are being moved together by the ram against the base. However, it is preferably that the anvil pin not be in a retracted position during the drilling operation so that drill shavings do not fall into the tubular anvil onto the retracted pin.

The drill having been withdrawn, the tail 62*a* of a rivet 62 is partially inserted in the rivet hole from the fixture side of the workpieces. Although the tool is useful with rivets not providing an interference fit, the primary purpose for the apparatus is to be able to insert rivets with an interference fit. The diameter of the rivet 62 is slightly larger than the rivet hole. Thus, in order to insert the rivet, it is necessary to drive or thrust it into the hole with an inserting anvil 64 extending through the fixture. In accordance with the invention, this driving force is accommodated by the workpieces by way of the upper end of the tubular anvil 22 which closely surrounds the hole in the workpieces. Installing the rivet, which is of material harder than the workpieces, enlarges the hole through the workpieces, and cold works the material forming the hole. This thereby provides a tight interference fit between the rivet and the workpiece, and simultaneously hardens the workpiece material surrounding the rivet shank.

The tubular anvil 22 satisfactorily accommodates the force which must be applied to the rivet to insert it. It should be noted that it is desirable that the workpieces not be deformed unnecessarily. If the clamping sleeve held the workpieces with sufficient force to handle the rivet-inserting force, an annular indentation might be formed in the lower workpiece by the clamping sleeve. Moreover, the workpiece material surrounding the rivet would protrude, rather than remaining flat. The tubular anvil prevents such protrusion since it closely surrounds the rivet hole.

Figure 3:
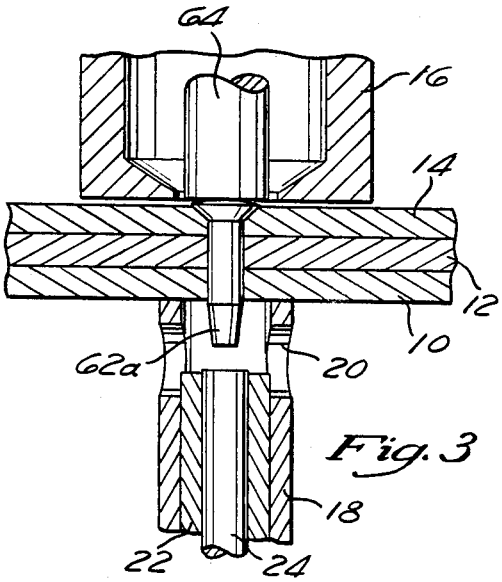
FIG. 3 illustrates the components of FIG. 2 immediately prior to the step of upsetting the rivet tail.
Figure 4:
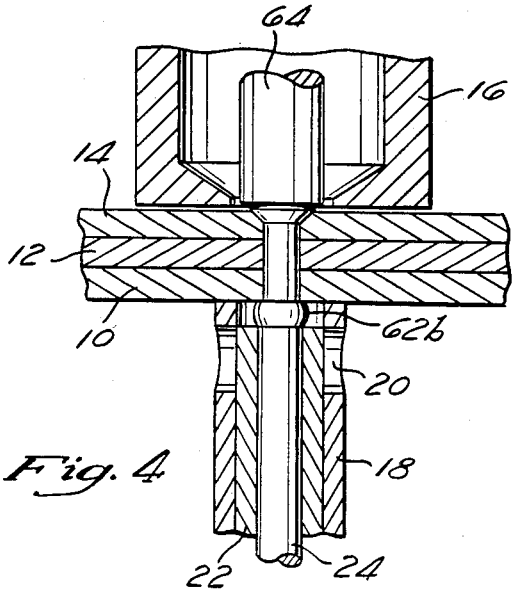
FIG. 4 illustrates the components of FIG. 3 at the completion of the step of upsetting the rivet tail.

Upsetting the rivet tail to form an upset head is the next step in the procedure; and preparatory to accomplishing this, the tubular anvil 22 is withdrawn such that the workpieces are once more only being held by the clamping sleeve 18 and the inserting anvil 64. The tubular anvil is withdrawn to the position shown in FIG. 3, and the actuator rod 48 is extended to snap the anvil pin to its raised position by the wedge. The wedge is positioned as shown in FIG. 6, with the cam surface 54*a* engaged by the wedge surface 46*c*. The two-part anvil is then in position to be operated as a single unit. It should be noted that the anvil pin 24 may protrude slightly beyond the end of the tubular anvil 22 before the head upsetting operation, in that the pin receives a greater load than the tubular anvil during the upsetting operation, and thus is slightly compressed to the position wherein it is flush with the end of the tubular anvil. The anvil is then moved towards the workpieces by the hydraulic ram 34 to form an upset head 62*b* from the tail of the rivet 62, as shown in FIG. 4. The inserting anvil 64 receives the reaction force. It should be noted that the clamping sleeve 18 is still providing its clamping force on the workpieces.

Figure 5:
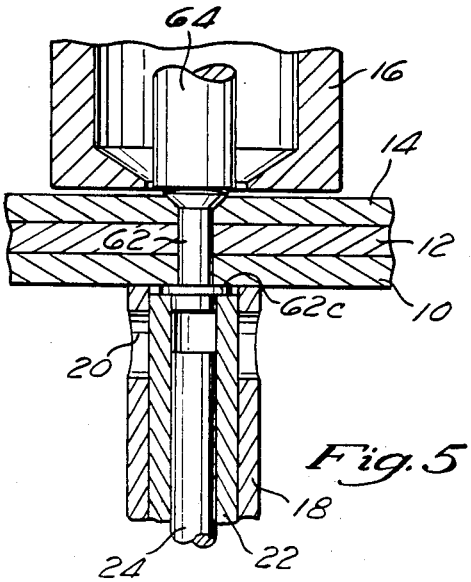
FIG. 5 illustrates the components of FIG. 4 in a form of the invention, wherein the upset head is further formed into a top hat configuration which provides tension on the installed rivet shank.

If it is desired that the rivet be left with a conventional upset head, as shown in FIG. 4, the riveting operation is complete, so that the clamping sleeve and the anvil may be withdrawn. If, however, the special form of rivet head is desired of the type disclosed in greater detail in the above-referenced patent, further processing steps are formed. The wedge 46 is once more withdrawn so that the anvil pin 24 can move to its retracted position with respect to the tubular anvil 22. The tubular anvil is then pressed towards the upset rivet head 62*b* by the ram 34, causing the anvil 22 to shear the outer portion 62*c* of the upset head and flatten it against the workpiece, creating somewhat of a top hat-shaped head, as shown in FIG. 5. The sleeve inner diameter is large enough to accommodate a flattened portion of rivet tail of the size needed (to develop full preload and strength). The clamping sleeve and the anvil may then be withdrawn in that the riveting operation is complete. Shearing the upset head 62*b* in that manner and then withdrawing the anvil, results in the rivet shank having a residual tensile in it which exerts a residual clamping force against the workpieces. Thus, there is provided a highly desirable riveted joint which is tight both axially and radially. A greater understanding of the method of making and the advantages of the "top hat" rivet is explained in the above-referenced patent.

It should be noted that the clamping sleeve dimensions are normally limited, the inside diameter has to allow for rivet tail deformation and for chips removal (blow off). The outside diameter is kept to minimum to allow riveting in tight spaces (close to a wall) and close spacing between rivets. Within limited dimensions the maximum clamping force possible is limited by material strength. Increased clamping force leaves imprints on the workpiece; and aluminum sheets "cave-in" when installing rivets with heavy interference, because support is away from the hole. By adding support from the anvil we engage about twice the area to allow bigger clamping force without damage to aluminum sheets, and sheets are supported right around the hole, so, no caving-in occurs. Thus it may be seem that the upset anvil being divided in two parts, center pin and shearing sleeve, allows not only installation of specific rivets of the type illustrated, but also heavy interference rivets of either kind.

It should be understood that there are a variety of riveting machines in use, and only one is illustrated, and that is in schematic form. The idea of employing the anvil pin, the tubular anvil and the surrounding clamping sleeve can be utilized with various machines with suitable modifications, in order to achieve the objectives desired in the manner above described.

What I claim is:

1. A method of installing a rivet with a rivet tail using an installation tool which includes an upset anvil pin surrounded by a tubular anvil, which in turn is surrounded by a clamping sleeve, said method comprising:

clamping work between a fixture and said sleeve;

forcing the tubular anvil against the work, with one end of the tube closely surrounding one end of a hole in the work;

thrusting the rivet through the hole from the fixture side of the work;

withdrawing said tubular anvil from said work while maintaining the work clamped by the sleeve; and driving said pin against the end of the rivet to form an upset head on the rivet tail.

2. The method of claim 1, including withdrawing said pin and driving said tubular anvil against said upset head to shear the outer portion of said head and flatten said portion against said work, with the flattened portion remaining integral with the portion of said upset head adjacent the work.

3. The method of claim 1, including the step of drilling said hole through said work from the fixture side to the sleeve side after said clamping but before said forcing.

4. The method of claims 1, 2 or 3, wherein during said forcing step the sleeve is maintained in its clamping position but said tubular anvil is forced against the work with a force greater than the clamping force.

5. The method of claims 1, 2 or 3, wherein said thrusting step is performed with a rivet having a diameter slightly larger than the hole in which it is installed, whereby said hole is enlarged by the rivet and the work material forming the walls of the hole is cold-worked by the rivet.

6. The method of claims 1, 2 or 3, wherein said anvil pin is withdrawn during said forcing and thrusting steps.

7. The method of claims 1, 2 or 3, wherein the anvil moves with the anvil pin to assist in forming the upset head as the end of the rivet is upset outwardly.

8. A method of installing a rivet, comprising the steps of:

clamping a stack of workpieces between a fixture and a sleeve;

drilling a hole through said workpieces from the fixture side to the sleeve side of the workpieces;

sliding a tubular anvil within the sleeve against the workpiece with the end of the anvil closely surrounding one end of the hole and with an anvil pin in said tubular anvil retracted with respect to said anvil;

maintaining the clamping force of said sleeve against the workpieces while applying a greater force to the anvil;

from the fixture side of the hole, forcing through the hole a rivet having a diameter slightly larger than the hole;

withdrawing the anvil from the workpiece while maintaining the workpieces clamped by said sleeve; and driving said anvil pin against the end of said rivet to form an upset head on the end of the rivet.

9. The method of claim 8, including the steps of:

withdrawing the anvil pin from the upset head; and driving said anvil against said upset head to shear partially the outer portion of the upset head and flatten it against the adjacent workpiece.

10. The method of claim 9, including driving the tubular anvil with the anvil pin during the driving step so that the tubular anvil assists in the formation of the upset head.

11. Rivet installation apparatus, comprising:

a clamping sleeve;

a tubular anvil positioned within said sleeve and mounted to be axially movable relative to said sleeve; and an anvil pin positioned within said anvil mounted for axial movement relative to the anvil.

12. The apparatus of claim 11, including:

means for axially forcing said pin against a rivet to form an upset head on the rivet; and means for selectively forcing said anvil and sleeve against work through which the rivet is being installed.

13. The apparatus of claim 12, including:

a base, said anvil being fixed to said base;

means for selectively moving said base and said anvil towards and away from said workpieces, said sleeve being slidably mounted on said anvil;

means for moving said sleeve towards and away from said work independently from said anvil, said pin being slidably mounted within said anvil; and means for axially selectively positioning said pin with respect to said anvil.

14. The apparatus of claim 13, wherein said means for moving said sleeve provides a force provided on said work which will remain at a selected level even though the base and anvil apply force to said workpieces greater than the force applied by said sleeve.

15. The apparatus of claim 14, wherein the means for moving said pin relative to said anvil includes a cam surface on the rearward end of said pin, and a wedge which is movable transversely with respect to said cam to axially move said pin.

16. The apparatus of claim 10, including means for axially moving said pin between a first position, wherein the pin is retracted with respect to said tubular anvil and to an extended position, wherein the pin is adapted to move with said tubular anvil to form an upset head.

* * * * *